United States Patent [19]

Sarazen

[11] Patent Number: 4,796,528

[45] Date of Patent: Jan. 10, 1989

[54] SEPARATED INK FOUNTAIN FOR A FLEXOGRAPHIC PRINTING MACHINE

[75] Inventor: David J. Sarazen, Hoboken, N.J.

[73] Assignee: M.A.N. Roland Druckmaschinen AG, Offenbach am Main, Fed. Rep. of Germany

[21] Appl. No.: 56,785

[22] Filed: May 29, 1987

[51] Int. Cl.[4] ..... B41F 31/06

[52] U.S. Cl. ..... 101/208; 101/211

[58] Field of Search ..... 101/207, 208, 209, 210, 101/350, 364, 363

[56] References Cited

U.S. PATENT DOCUMENTS

| | | | |
|---|---|---|---|
| 1,919,283 | 7/1933 | Troy | 101/210 |
| 3,032,007 | 5/1962 | McCauliff | 101/210 X |
| 3,831,517 | 8/1974 | Wagner | 101/208 |
| 4,165,688 | 8/1979 | Ceanna et al. | 101/207 |
| 4,366,754 | 1/1983 | Sarda | 101/208 |
| 4,513,662 | 4/1985 | Schneider | 101/207 |
| 4,513,662 | 4/1985 | Schneider . | |
| 4,559,871 | 12/1985 | Kutzner et al. | 101/207 |
| 4,667,595 | 5/1987 | Geretzk | 101/207 |

FOREIGN PATENT DOCUMENTS 1263650 2/1972 United Kingdom .

*Primary Examiner*—J. Reed Fisher

*Attorney, Agent, or Firm*—Frishauf, Holtz, Goodman & Woodward

[57] ABSTRACT

To separate a flexographic ink fountain into axial zones (10*a*, 10*b* . . . ) to permit use of inks of different characteristics, for example different colors along axial zones of an anilox roller (10), a separator element (2) has an insert strip element (3) extending over a portion of the circumference of the anilox roller, and resiliently engaged thereagainst, for example by compressed silicone rubber (5). Adjacent the end of the strip element (5) are two felt pads (21, 31) which are supplied from a source of separating fluids, such as water, alcohol-water solution or the like, to apply a ring-shaped film of the separating liquid on the anilox roller which film will continue beneath the separating strip (3), the separating strip being engaged against the roller with sufficient pressure to permit the strip to ride on the liquid film, similar to planing of autombile tires on a wet road surface. Two doctor blades are located on a trough structure, selectively moveable away from engagement with the surface of the anilox roller in dependence on rotation of the anilox roller. Additionally, the doctor blades (23, 33) can both be spaced from the surface of the anilox roller by a distance just sufficient to clear the anilox roller (10) thus permitting continued operation of the anilox roller when not in use under idling speed conditions, and preventing drying of ink on the anilox roller. When the doctor blades are removed from the anilox roller, the compressible material, and expansion of the felt pad retains the separating film of liquid on the anilox roller, thus saving "wash up" between extended periods when the machine is not printing while conserving the surface of the anilox roller and the edges of the doctor blades.

19 Claims, 2 Drawing Sheets

SEPARATED INK FOUNTAIN FOR A FLEXOGRAPHIC PRINTING MACHINE

The present invention relates to printing machines and more particularly to flexographic printing machines, and especially to an ink system or ink fountain therefore, in which the ink fountain is subdivided into axially different zones to permit application of inks of different colors in the respective zones to corresponding zones on an application, or anilox roller.

BACKGROUND

Flexographic printing machines are increasingly used in the printing field. Usually, flexographic printing machines were used to print on bags, wrappers, cartons and boxes. Recently, flexographic printing is being used outside of the packaging field, particularly for books, magazines, stationery and the like A good discussion of flexographic printing is found in "Machine Printing" by Durrant, Meacock and Whitworth, copyright 1973 by Hastings House Publishers, New York, N.Y.

It has previously been proposed to separate inks of different characteristics, for example of different colors with respect to actual zones on an ink ductor roller against which at least one and usually two doctor blades are engaged, see, for exam U.S. application, Ser. No. 921,338, filed Oct. 21, 1986, now U.S. Pat. No. 4,754,701 Batke et al. This application is directed to a system in which a separating plate is located beneath an axially extending doctor blade. The separating plate has a sealing element attached thereto, resiliently engaging the underside of two doctor blades facing the ductor or trough roller from different directions to permit operation of the ductor or trough roller in either direction of rotation. A low friction surface is applied to the edge which faces the doctor blades, the sealing elements spanning the space between the doctor blades and being matched to the circumference of the ductor or trough roller. The doctor blades extend axially beyond the sealing elements. The separating plates and sealing elements can be mounted on units which are actually positioned along on ink trough and hence the ductor or trough roller, at selected positions, as required by the axial extent of different colored inking zones.

German Patent Disclosure Document DE-OS No. 23 20 638, referred to in the aforementioned Batke patent application, describes an arrangement in which two ink separating sheet metal elements are engaged by spring force directly to the circumference of a ductor roller in order to separate differently colored inks from each other. The lateral sealing of the ink reservoir or ink sump region is obtained by engaging the separating elements against the faced surface of the doctor blades or stripper blades.

THE INVENTION

It is an object to provide a flexible arrangement to separate axial zones on an anilox roller for a flexographic printing machine so that inks of different characteristics, for example of different color can be supplied to the respective zones, without overlap; which is simple, inexpensive and provides for effective sealing of the axial zones with respect to each other.

Briefly, a separating strip element preferably having a low friction surface has a curved surface fitting against and matching the surface of the anilox roller. The curved surface extends over a portion of the circumference thereof. To positively separate the inks of different characteristics, thus preventing migration of ink between the two or more ink zones and to eliminate the effect of abrasion in the water based flexographic inks, a thin film of a hydraulic separating liquid is placed between the strip element and the surface of the anilox roller. Typically,the strip element is made of "Teflon" ®, and the separating liquid is water. Other separating liquids, like water-alcohol mixtures, or ink solvents may be used. The liquid film applied to the region beneath the strip by placing two liquid saturable elements adjacent the end portions of the strip elements. Felt is a preferred material; other spongy materials can be used. Liquid is introduced to the felt elements, which will operate as wicks, to place the thin liquid film just in the region of the separating strip. "Teflon" is a polytetrafluoroethylene plastic.

In accordance with the preferred feature of the invention, the strip element is backed by silicone rubber, for example, of the low durameter type. This permits the seal to become self aligning regardless of direction of rotation of the anilox roller.

Anilox rollers are customarily used with doctor blades. In accordance with the feature of the invention, the doctor blades are cut, or made such that they terminate at the separating elements. The rubber back up permits sealing the corners of the doctor blade inside the ink chambers adjacent to the ink separators, and thus effectively seals the edges of the doctor blades as well, by plastic deformation of the silicone rubber, that is, bulging over the edge upon application of pressure.

In accordance with another feature of the invention, the fountain system is so arranged that a holder structure for the separating strip element, the back-up rubber, and the felt pads or, preferably, the entire ink fountain can be moved for selective engagement of either one of the doctor blades with the anilox roller, in dependence on the direction of rotation of the anilox roller and, further, so moved that both doctor blades clear the anilox roller, while the separating element and preferably also the pads remain in engagement with the surface of the anilox roller. This has the advantage that, during non-printing periods, the anilox roller can be permitted to continue to rotate, with ink being circulated in the ink fountain, thereby preventing drying of the ink on the anilox roller without, however, engaging one of the doctor blades with the anilox roller thereby substantially reducing wear and tear on both the anilox roller as well as the respective doctor blade or blades.

DRAWINGS

DETAILED DESCRIPTION

Figure 1:
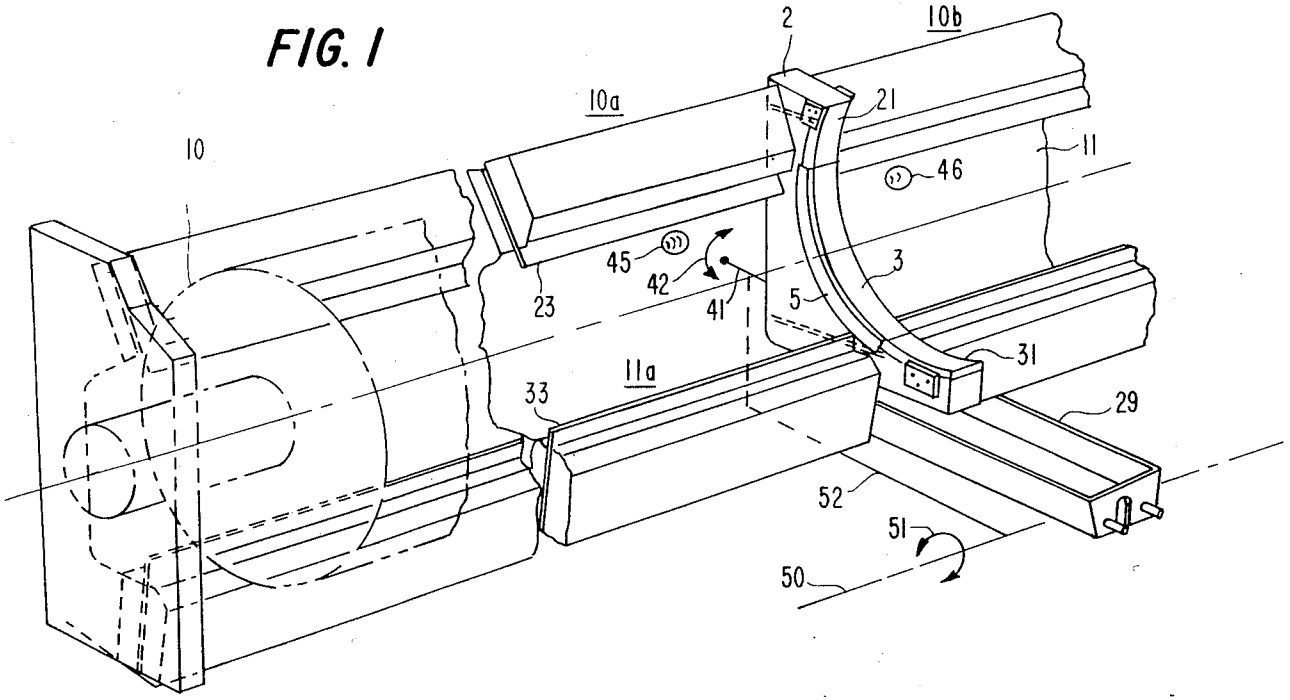
FIG. 1 is a general perspective view of a flexographic inker,(wherein the anilox roller is shown in phantom), subdivided axially, in accordance with the present invention.

An anilox roller 10, of standard construction, and for example of about 28 cm diameter (about 11") is separated into axial zones, corresponding to axial zones 10*a*, 10*b*, or more, in dependence on requirements of the fountain. A separator element 2, for example of plastic—nylon being suitable—is retained in a suitable portion of the ink fountain, shown only schematically at 11 by screws 12. Fountain 11, defining an ink cavity 11*a* is retained on the machine frame as well known. It can pivot slightly about an axis 11*b* (FIG. 2) perpendicular to the plane of FIG. 2. The separator element is narrow, and extends over a portion of the circumference of the anilox roller 10. separator element 2 is formed with a cutout 13 into which a "Teflon"seal 3, backed up a silicone rubber back-up element 5 is placed. For newspaper printing, a width of the elements 3, 5 of about 15 mm is suitable.

The silicone rubber back-up element 5 uniformly distributes the pressure of the "Teflon" separator strip 3 about the circumference of the anilox roller. Compressive force of the silicone rubber can be obtained by pressure against the anilox roller 10. Thus, the pressure of the separator strip 3 against the anilox roller can be controlled.

In accordance of the feature of the invention, a thin film of liquid, typically water, is applied between the anilox roller 10 and the "Teflon" separator strip 3. This thin film of water is derived from two felt pads 21, 31, which are supplied with water from a water supply duct system. The water supply duct system is formed by a hollow bolts 14*a*, 14*b*, which, are threaded into the separating element 2, and communicate with ducts 15*a*, 15*b* formed in the separating element and terminating at the felt strips 21, 31, respectively. The shapes of the ducts can be matched to any suitable requirement, for example straight, as shown at 15*a*, or angled or bent as shown at 15*b*. A water trough 29, located beneath the entire assembly, receives any excess or dripping water.

The bolts 14*a*, 14*b* are threaded at the outside, and nuts 16*a* 16*b* though not necessary, may be used to retain the bolts against the frame 11. The bolts 14*a*, 14*b* are coupled by suitable hydraulic coupling 17*a*, 17*b* to a hydraulic supply line, shown schematically and including such common hydraulic elements as elbows, unions and the like, as well as, valves 18*a*, 18*b*. Water then can be supplied selectively to the respective felt strips 21, 31. The felt strips 21, 31 are held in position on the separator element 2 by retaining plates 22, 32, which engage the felt strips 21, 31, from both lateral sides; only one of the clamping plates 22, 32, is visible in FIG. 2.

Figure 2:
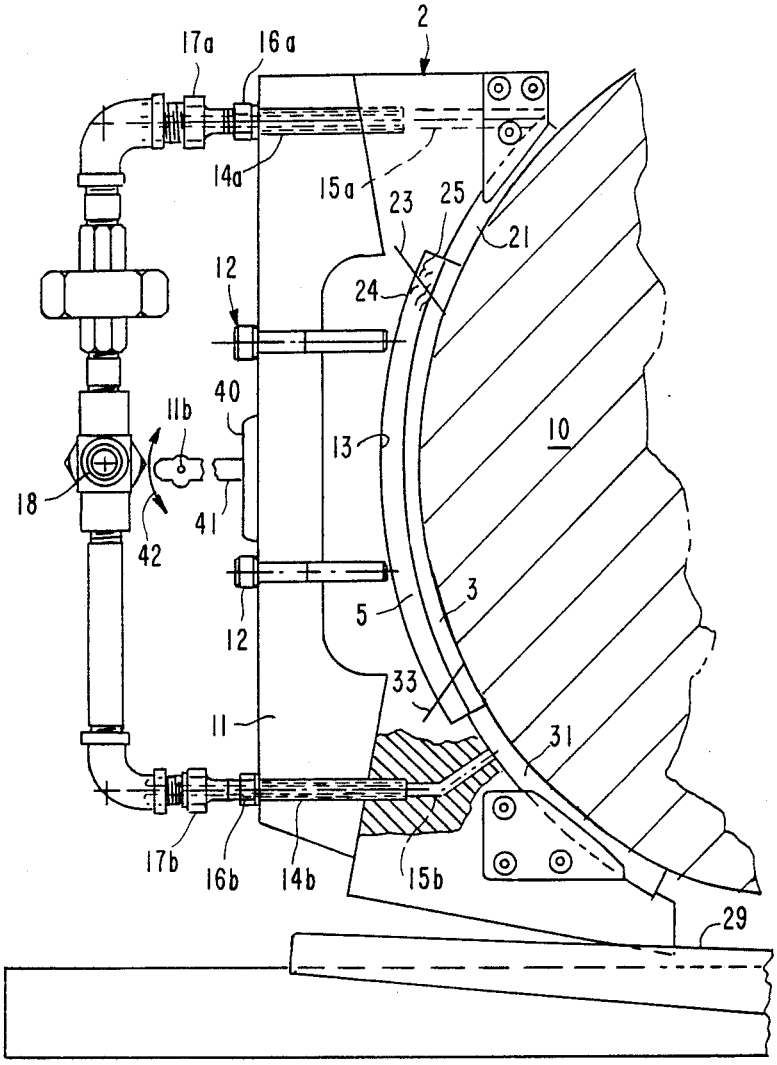
FIG. 2 is a schematic axial cross sectional view through an anilox roller and showing the ink separator in accordance with the present invention.

Doctor blades 23, 33 are selectively engaged with the surface of the anilox roller, and extend axially, that is, perpendicular to the plane of the drawing of FIG. 2. They are secured in position in the fountain. To provide for selective engagement of the doctor blades 23, 33 in dependence on roller rotation, the fountain is pivoted about pivot axis 11*b*. The doctor blades can be pressed axially into the silicone rubber back-up 5, which will slightly compress and bulge around the doctor blade as schematically shown at 23, 24, thus providing a tight seal thereagainst. Preferably, the "Teflon" strip 3 is formed with sharp corners. The "Teflon" strip 3 and the silicone rubber back-up 5 can be seated in the recess 13 by being adhered therein, for example by a pressure sensitive adhesive.

The water ducts through the bolts 14*a*, 14*b*, and the connecting ducts 15*a*, 15*b* through the separator element 2 can be quite small, for example about two to three mm in diameter, just enough to drip water to the pads 21, 31, so that a hydraulic film will form beneath the "Teflon" ® strip 3, to separate adjacent axial zones 10*a*, 10*b* . . . . and corresponding zones on the anilox roller. The circumferential length of the felt strips, for a roller of about 28 cm diameter can be about 7 to 8 cm.

Applying a thin film of water between the "Teflon" strip 3 and the surface of the anilox roller 10 has the advantage that the separator strip will not damage the anilox roller and provide a seal with an extended life span which, additionally, is not affected by high rotational speed of the anilox roller 10. Using water as a film liquid has an additional advantage because it prevents drying of flexographic ink on the anilox roller in the region of ink separation, thus eliminating the abrasive characteristics of water based inks, which otherwise cause wear of sealing material due to build up of dry ink on the anilox roller.

The amount and direction of water flow to be used can readily be controlled by operation of a three way valve 18 in the water supply system to the ducts 15*a*, 15*b*. The quantity can be easily determined by experimentation; just enough water should be used so that the ink separator region does not dry or harden on the anilox roller. Besides the interaction of the water film with the ink, the water will additionally act as a lubricant, and form a hydraulic film around the circumference of the anilox roller. Thus, the "Teflon" strip 3 will ride on the film, and even though the pressure may be considerable, the effect will be similar to that of planing of rolling automobile tires on a road surface which is wetted. This hydraulic film effectively eliminates friction, and prolongs the life of the seal. Just as in planing of automotive tires on a road surface, the friction is low.

Ink migration across the separator is effectively inhibited since the hydraulic film permits liquid to remain only between the anilox roller and the "Teflon" seal, and, in turn, prevents the entrance of ink between the "Teflon" seal and the anilox roller. Thus, migration of ink of one c[characteristic, for example, of one color to ink of another characteristic, for example, of another color is effectively prevented.

Use of a separate rubber back-up 5 is not strictly necessary but preferred. It permits ready replacement and provides uniform even sealing pressure. A low durometer material, for example, a closed silicone rubber of 30 durometer, and located behind the "Teflon" sealing strip provides uniform, even sealing pressure against the face of the anilox roller. The low durometer silicone rubber between the wall of the separating element 2 and the "Teflon" seal also provides for effective sealing of the corners of the doctor blades. This type of silicone rubber permits about 20% compression, which causes the slight side expansion 24,25 of the silicone rubber around the blade ends and corners.

Various materials can be used to form the water film application elements 21, 31; felt is particularly suitable since it permits a metered dripping or application of water through the separator strip 3. The water comes with the felt pads 21,31 located above and below the "Teflon" seal. The density of felt is such that an even distribution of water is obtained. The water seeps to the lower portion of the felt pads by gravity.

The arrangement has the additional advantage of low cost. Teflon is substantially more expensive silicone rubber or felt, and using a thin small strip of "Teflon" backed up by silicone rubber with felt pads on either side reduces the amount of "Teflon" used. The "Teflone" is only used in the areas of the ink fountain, between the upper and lower doctor blades.

In accordance with the feature of the invention, the entire ink fountain 11, together with the separator element 2, the strip element 3 the back-up element 5 thereof and the doctor blades 23, 33 can be pivoted about the axis 11*b*. The fountain 11 is retained on the machine frame by a bracket 40, coupled to a holder rod 41 which can be pivoted about the pivot axis 11*b*, as shown schematically by arrow 42. The holder rod 41 is shown broken since the pivot axis 11*b* is usually further toward the left—with respect to FIG. 2—and would not normally be visible in the drawing, for example, being hidden by the valve 18. The location in FIG. 2 has been selected only for clarity of illustration. The fountain 11 is usually trough shaped, to define the ink cavity 11*a*. Ink is continously admitted to the ink cavity by inlet openings 45, and removed by outlet openings 46, ink being continuously circulated in the ink cavity. The anilox roller 10, engaged or just slightly spaced from the doctor blades 23, 33 prevents loss of ink.

In accordance with the feature of the invention, the ink fountain 11 can be removed with respect to the anilox roller 10 such that both doctor blades 23, 33 lose contact with the anilox roller 10. The movement is slight, a fraction of a millimeter. This permits continued circulation of flexographic ink in the ink trough 11*a*, and rotation of the anilox roller 10 at low or idle speed, thereby preventing drying of ink on the roller 10 during periods of time when printing is not being effected, while maintaining separation of inks of different colors, for example, in the different zones 10*a*, 10*b*. The strip, element 3 as well as the pads 21, 31 will expand slightly—after having been compressed—but not sufficient to lose contact with the anilox roller; if one, or both of the pads 21, 31, should lose contact over a portion of the surface, little harm is done; sufficient water will be applied to form a ring-shaped liquid film in alignment with strip 3 around the anilox roller 10 so that the strip 3 will ride, or plane on the ring-shaped film, thereby continuously preventing ink from the zones 10*a*, 10*b* from merging or bleeding over each other while still permitting rotation of the anilox roller, while it remains positioned in front of the ink cavity 11*a*. The movement of the ink trough so that the doctor blades 23, 33 clear—that is, just barely clear the roller 10, while permitting the back-up rubber 5 as well as the pads 21, 31 to expand can be obtained in any suitable manner; as shown in FIG. 1, a common shaft 50 extends longitudinally of the inker, parallel to the ink trough 11. It can be pivoted as shown by arrow 51. Shaft 50 is coupled by an angled lever 52 to the support rod 41, or the bracket 40, respectively of the separator element 2 tilt mechanism.

OPERATION

If the anilox roller 10 operates in clockwise, or forward rotation, the upper felt pad should be removed, and the upper drip system shut off, for example, by turning valve 18 to direct water to lower pad 31. The lower felt pad 31 remains in place and the lower drip or water application system is activated by valve 18 By wick action, pad 31 will apply a thin film of water on roller 10 which will permit strip 3 to ride on the film. Upon rotation of roller 10, a ring of water film will form on the roller 10, separating adjacent zones of ink. Fountain 11 is pivoted about axis 11*b*, see arrow 42, to disengage doctor blade 23. Rubber backing 5 will equalize engagement pressure of strip 3 against roller 10. Upon reversing rotation to counter clockwise or reverse anilox rotation, the lower drip system can be turned off by changing position of valve 18 and the lower felt pad 31 can be removed. The upper felt pad 21 remains in place and the upper drip system is activated. The non-wetted felt pads should be removed to prevent drying. Removal of the felt pad is simple, by merely slipping them out, possibly also loosening holding screws holding the respective clamping plate 22, 32, and then removing the respective felt strips 21, 31.

Under normal printing conditions, 10 may operate at speeds of up to about 800 rpm, for example. If the machine is not printing it has been customary to stop ink flow and engage in a "wash up", to prevent drying of the rapidly evaporating ink on the anilox roller 10 and in the fountain. In accordance with the feature of the present invention, however, the roller 10 can be permitted to continue to operate at idle speed, for example, at about 30 rpm, with ink continuously being circulated between inlets 45 and outlets 46—shown in FIG. 1 only in different ink zones—while separating the ink zones from each other. Upon tilting of shaft 50 in counterclock wise direction of arrow 51, both doctor blades 23 and 33 will be removed from engagement with the anilox roller 10. The tilt axis of shaft 50 is preferably in essential vertical alignment with the axis of rotation of anilox roller 10, and, for example, somewhat below the ink trough 29. The normal compression of the rubber backing 5, when printing, may be about 25% of its nominal., uncompressed thickness; that of the felt pads about 10%. Slightly tilting the fountain 11 permits some expansion of the rubber liner backing 5, and of the felt pads 21, 31, without loss of their function however. Thus, wash up can be eliminated during idling periods; the strip element 3 and the pads 21, 31 will remain in engagement with the roller 10, thus separating ink zones, while preserving the edges the doctor blades 23, 33 and the surface of the anilox roller.

Various changes and modifications may be made within the scope of the inventive concept.

I claim:

1. In a flexographic printing machine, an arrangement to separate an ink fountain (11) into different axial zones (10*a*, 10*b*) to permit use of inks of respectively different characteristics on various zones of an anilox roller (10) comprising a separating strip element (3)

and means (21, 14*a*, 15*a*; 31, 14*b*, 15*b*; 18) for introducing a hydraulic film of a separating liquid between the surface of the strip element (3) and the surface of the anilox roller (10), including a pad element (21, 31) of a porous substance, positioned in alignment with said separating strip element (3);

liquid supply means (14*a*, 15*a*; 14*b*, 15*b*) in hydraulic fluid communication with said pad element (21, 31) of the porous substance; and the separating strip element (3) having a curved low-friction surface fitting against and matching the surface of the anilox roller (10), positioned, with respect to the direction of rotation of the anilox roller, downstream from said pad element (21, 31), and extending over a portion of the circumference of the anilox roller, the hydraulic film forming a ring of liquid essentially only in the circumferential region of the anilox roller which includes said portion of the circumference thereof, to float the separating strip element (3) on said ring of separating liquid.

2. The arrangement according to claim 1 wherein said separating liquid comprises water.

3. An arrangement in accordance with claim 2 wherein two pad elements (21,31) and two liquid supply means are provided, the respective pad elements being located adjacent extreme ends of said separating strip element (3).

4. An arrangement in accordance with claim 2 wherein said pad element of porous substance comprise felt means.

5. An arrangement in accordance with claim 1 further comprising a back-up element (5) located adjacent the separating strip element (3) at a side thereof remote from said anilox roller (10), said, back-up element comprising a compressible material.

6. An arrangement in accordance with claim 5 wherein said compressible material comprises silicone rubber.

7. An arrangement in accordance with claim 5 further including a separator element (2) defining a holder structure, said holder structure being formed with a recess (13) extending part circumferentially around said anilox roller, said back-up element (5) being retained in said recess;

and adjustable means (12, 16*a*, 16*b*) adjustably engaging the separator element to provide an essentially radially directed force against said back-up element and to compress said compressible material and press the separator element (3) against the surface of the anilox roller (10).

8. An arrangement in accordance with claim 5 further including doctor blade means (23, 33) having an axial length extending up to the separator element, said doctor blade means (23, 33) engaging with an edge portion against said back-up element (5) of compressible material to permit the compressible material to bulge out against the doctor blade means and seal the edge of the doctor blade means.

9. An arrangement in accordance with claim 1 further comprising a separator element (2) defining a holder structure;

resilient support means (5) for resiliently supporting said strip element (3) on the holder structure for essentially uniform part-circular resilient engagement of the strip element with the anilox roller (10);

doctor blade means (23, 33) located on the ink fountain (11); and means (41, 42; 50, 51, 52;) movably supporting the ink fountain for selective engagement with the doctor blade means with the anilox roller, or disengagement of the doctor blade means by a slight distance sufficient to clear the doctor blade means from the anilox roller while retaining resilient engagement of the strip element (3) with the anilox roller (10) and continued application of separating liquid to he anilox roller by said liquid application means.

10. An arrangement in accordance with claim 9 wherein said means for introducing the hydraulic film of the separating liquid comprises two wick-type pad elements (21, 31) of a porous substance, positioned in alignment with said strip element (3) at extreme ends of the strip elements;

two doctor blades are provided, forming said doctor blade means, a first doctor blade being associated with the anilox roller in one direction of rotation, and a second doctor blade being associated with the anilox roller in reverse direction of rotation;

and wherein the movable support means permits selective engagement with the anilox roller of (a) the first doctor blade;

(b) the second doctor blade; and (c) neither doctor blade, while maintaining the anilox roller (10) in fluid transfer position with at least one of said pad elements (21, 31).

11. The arrangement of claim 1 wherein said separating liquid comprises at least one of water; water-alcohol mixtures; ink solvents.

12. In a flexographic printing machine, an ink fountain (11) including an arrangement to separate the fountain into different axial zones (10*a*, 10*b* . . . ) to apply ink on an anilox roller (10) in different axial zones thereof and to permit use of inks of respectively different characteristics, for example of different colors, in the various zones comprising a separator (2) having a surface facing the anilox roller (10) which extends over a portion of the circumference thereof; said separator including a separating strip element (3) having a curved surface of low friction material fitting against and matching the surface of the anilox roller;

a back-up means (5) of compressible material secured to said separator element, and retaining said separating strip element (3) in position, extending over a portion of the circumferential dimension of said separator element (2);

a pad element (21, 31) of a fluid pervious, porous substance retained on said separator element (2) adjacent the end portions of the separating strip element (3) and extending away from the end portions of the separating strip element;

fluid supply means (14*a*, 15*a*; 14*b*, 15*b*; 18) connecting a source of separating fluid to said pad element to apply a separating fluid thereto, and, in turn, form a film of separating fluid on the surface of the anilox roller (10) and between the surface of the anilox roller (10) and the separating strip element (3);

and means (12, 41, 42; 50, 51, 52) for engaging the separator element (2) towards the surface of the anilox roller (10).

13. The arrangement of claim 12 wherein said separating strip element comprises polytetrafluoroethylene; said back-up means comprises silicone rubber; and said pad element comprises a felt pad.

14. The arrangement of claim 12 wherein said separator (2) defines a holder structure;

two pad elements are provided, one each located at an extreme end of the separating strip element;

two doctor blades are provided, a first doctor blade (23) being associated with one direction of rotation of the anilox roller (10) and a second doctor blade (33) being associated with reverse direction of rotation of the anilox roller, said doctor blades being secured to said ink fountain;

and wherein the engagement means for engaging the separator against the surface of the anilox roller include means (41, 42; 50, 51 52) for movably supporting the ink fountain for selective engagement of either one of said doctor blades with the anilox roller in dependence on the respective direction of rotation of the anilox roller, or disengagement of both doctor blades with the surface of the anilox roller by separating edges of the doctor blades from the surface of the anilox roller by a slight distance to clear the anilox roller while retaining resilient engagement of the separating strip element (3) with the anilox roller and of at least one of said pad elements with the anilox roller to continuously apply separating fluids to the anilox roller and form said film of separating fluid between the surface of the anilox roller and the surface of the separating strip element.

15. The arrangement of claim 12, wherein said separating liquid comprises at least one of: water; water-alcohol mixtures; ink solvents.

16. A method of sealing flexographic printing inks or different colors from each other and separating said inks in axial zones of an anilox roller (10) comprising the steps of:

providing a separating strip element (3) having a low-friction surface which is curved, matches the surface of the anilox roller (10), and extends over a portion of the circumference thereof;

forming a circumferential ring of a film of separating liquid between said zones by applying a porous wick-like pad against the surface of the anilox roller and saturation said pad with said liquid;

resiliently engaging said separating strip element against said ring of the film of separating liquid;

floating said separating element on said film; and said step of forming the circumferential ring of the film of separating liquid comprises introducing just enough liquid upstream, in the direction of rotation of the anilox roller, to provide for effectively planing of the separating strip over the film of liquid.

17. Method according to claim 16 wherein said liquid comprises water.

18. Method according to claim 16 for use in a flexographic printing machine having two doctor blades (23, 33) selectively engagable with the anilox roller (10), or separable therefrom, wherein the step of introducing said film of liquid comprises maintaining said film of liquid on the anilox roller and continuing to float the separating element on said film when the doctor blades are separated from the anilox roller.

19. Method according to claim 16 wherein said separating liquid comprises at least one of: water; water alcohol mixtures; ink solvents.

* * * * *